US005356117A

United States Patent [19]

Engel

[11] Patent Number: 5,356,117

[45] Date of Patent: Oct. 18, 1994

[54] HOLLOW TRUNNIONS FOR SCISSOR JACKS

[75] Inventor: Darryl L. Engel, LaOtto, Ind.

[73] Assignee: Universal Tool & Stamping Company, Inc., Butler, Ind.

[21] Appl. No.: 84,129

[22] Filed: Jul. 1, 1993

[51] Int. Cl.[5] ..... B66F 3/08

[52] U.S. Cl. ..... 254/126

[58] Field of Search ..... 254/126, 122, 124, 8 B, 254/9 B, 10 B; 403/154, 161, 163

[56] References Cited

U.S. PATENT DOCUMENTS 4,583,713 4/1986 Fukura et al. ..... 254/126

4,771,986 9/1988 Nasu ..... 254/126

5,117,546 6/1992 Lawrence et al. ..... 254/105

*Primary Examiner*—Robert C. Watson

*Attorney, Agent, or Firm*—Hill, Steadman & Simpson

[57] ABSTRACT

Hollow trunnions for a scissors type jack which allows a lighter jack to be produced. The hollow trunnion may be formed into a hollow tube and welded and formed with openings for the lead screw. The hollow trunnion may also be formed from solid tubing. A flatted portion may be formed on the trunnion to provide a bearing surface. A modification provides a U-shaped bracket which attaches to the hollow trunnion and which carries a nut through which the screw extends.

5 Claims, 3 Drawing Sheets

FIG. 6
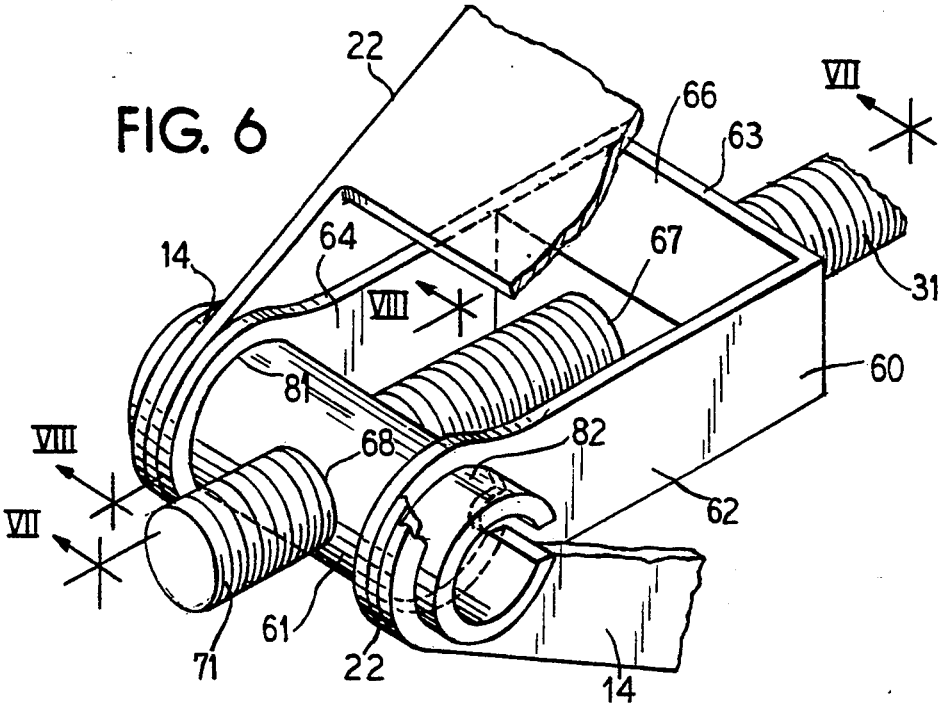
FIG. 7
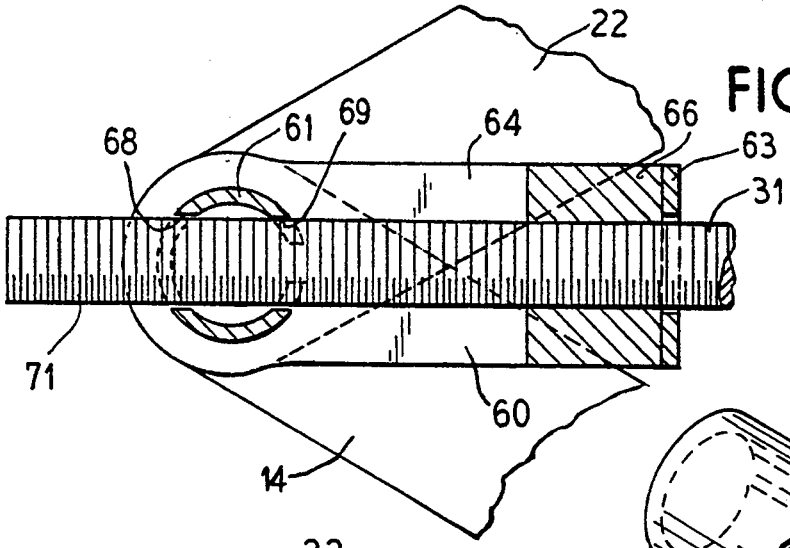
FIG. 9
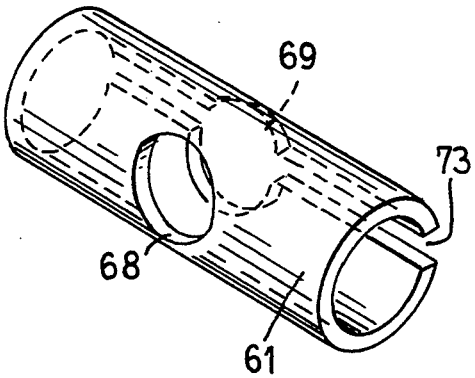
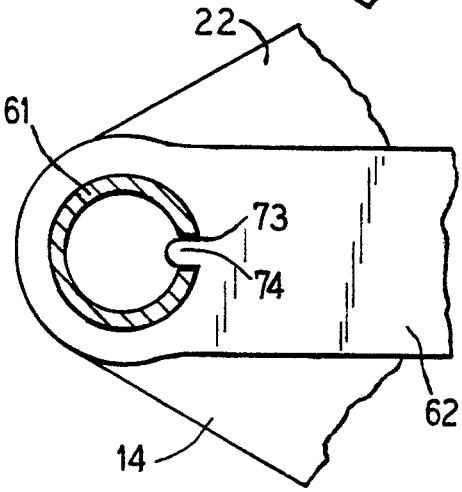
FIG. 8

FIG. 10
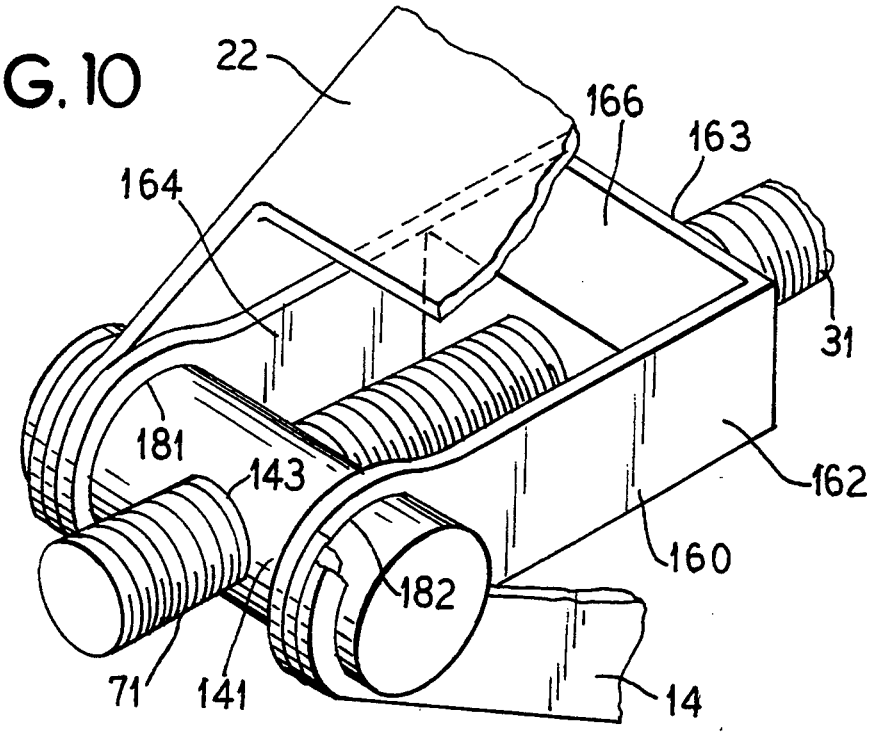
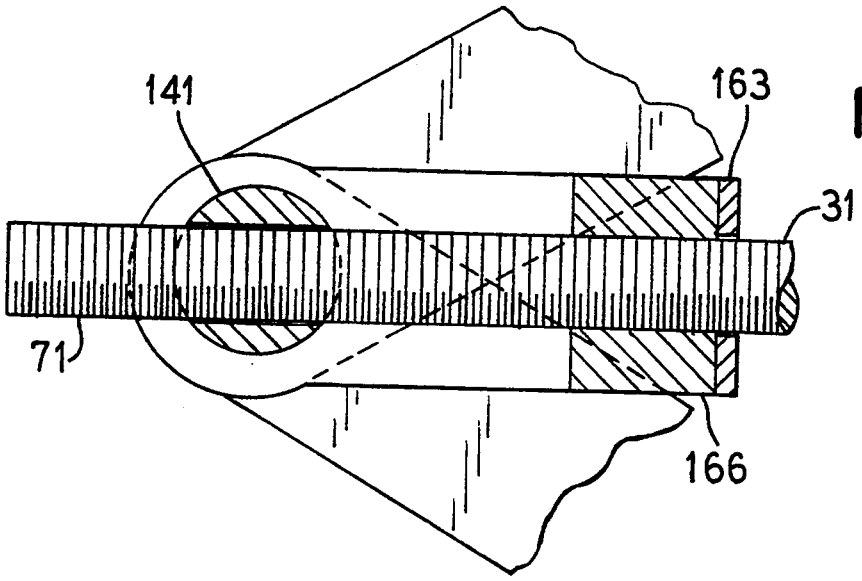
FIG. 11
FIG. 12
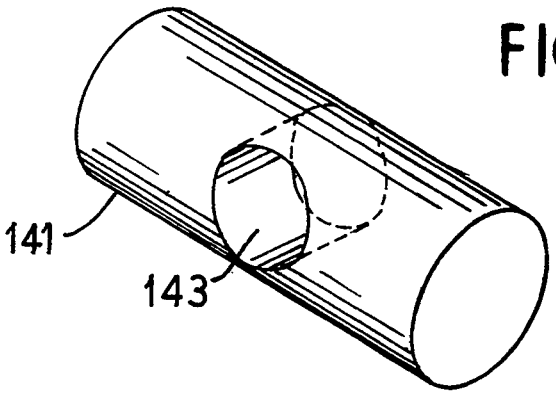

HOLLOW TRUNNIONS FOR SCISSOR JACKS

BACKGROUND OF THE INVENTION

1. Field of the Invention

This invention relates in general to scissors jacks and, in particular, to novel hollow trunnion designs.

2. Description of Related Art

For jacks such as scissor jacks, solid trunnions have been used which are produced by either a turning operation or by cold heading. When produced by turning operations, metal scrap occurs. When trunnions are formed by the cold heading process, more costly tooling than the turning operation is required.

See also the following U.S. Pat. Nos. 2,543,904, 4,836,502, 2,920,871, 4,749,169, 4,720,081, 4,583,713, 4,893,785 and 3,679,176.

SUMMARY OF THE INVENTION

The improved hollow trunnions of the invention are substantially lighter than the solid trunnions of the prior art. They also result in less scrap and are less expensive than the prior art solid trunnions. The hollow trunnions of the present invention allow an assembled product such as a scissors jack to be lighter than prior art devices.

It is a feature of the present invention to provide a hollow trunnion which has a hollow cylindrical shape and which can be formed either from solid tubing or, alternatively, can be formed by a stamping process and which is formed with cross-holds for receiving the screw therethrough.

Another feature of the hollow trunnion of the invention is to provide a flattened area on one side which serves as a bearing surface for a thrust bearing of the jack.

Another modification of the hollow trunnion of the present invention provides for a hollow cylindrical trunnion member to which a bracket is connected that carries a threaded nut member so as to threadedly receive the screw of the jack. The hollow trunnion may be formed with spaces into which locking projections of the bracket may extend so as to assure alignment of the threaded opening in the screw with the openings through the hollow trunnion.

It is a feature of the present invention is to provide lighter and simpler trunnions for jacks so as to decrease the weight of the jack and also to reduce the cost of the jack.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 6 is a perspective view illustrating the modified hollow trunnion with a bracket which carries a threaded screw attached therethrough;

FIG. 7 is a sectional view of the invention of FIG. 6;

FIG. 8 is a detailed sectional view of the invention of FIG. 6;

FIG. 9 is a perspective view of the hollow trunnion of FIG. 6;

FIG. 10 illustrates a modified form of the invention;

FIG. 11 is a sectional view from FIG. 10; and

FIG. 12 illustrates a trunnion of the embodiment of FIG. 10.

DETAILED DESCRIPTION OF THE PREFERRED EMBODIMENTS

Figure 1:
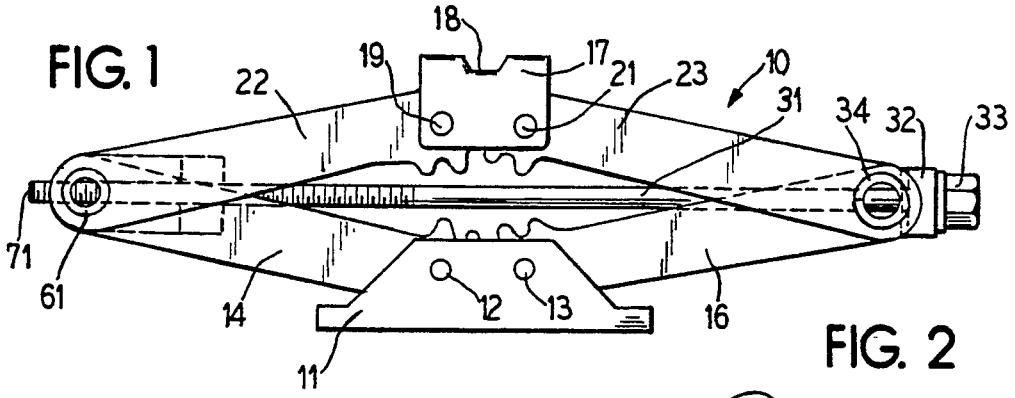
FIG. 1 is a side plan view of a scissors jack with the hollow trunnions of the invention mounted therein.
Figure 2:
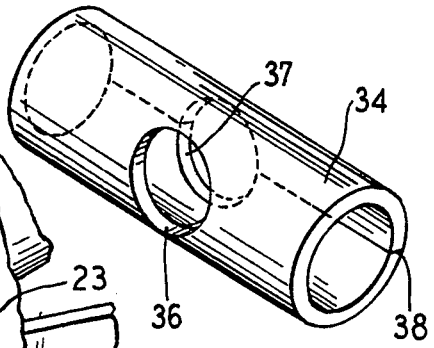
FIG. 2 is a perspective view of a hollow trunnion according to the invention.
Figure 5:
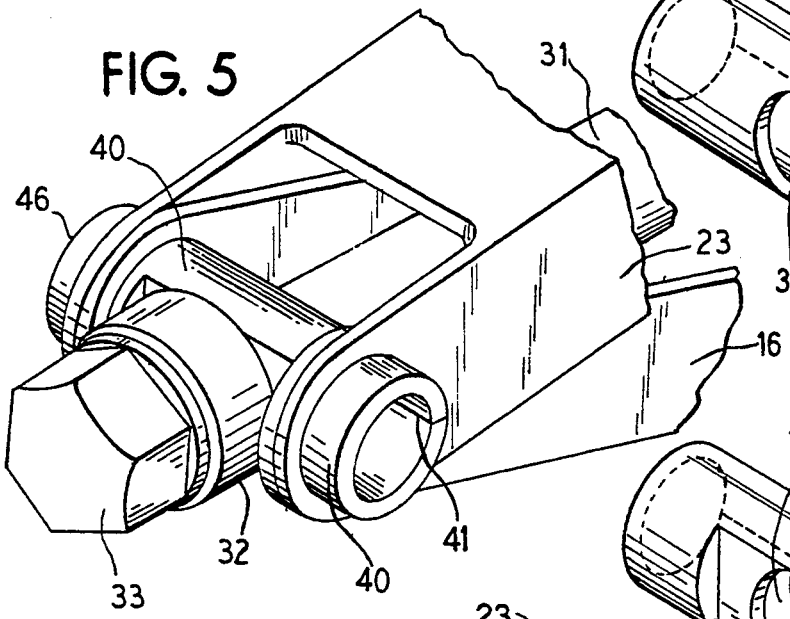
FIG. 5 is a perspective view illustrating the hollow trunnion of FIG. 3.
Figure 3:
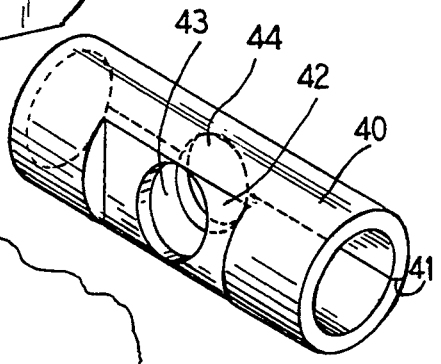
FIG. 3 is a perspective view of a modified form of the hollow trunnion of the invention.
Figure 4:
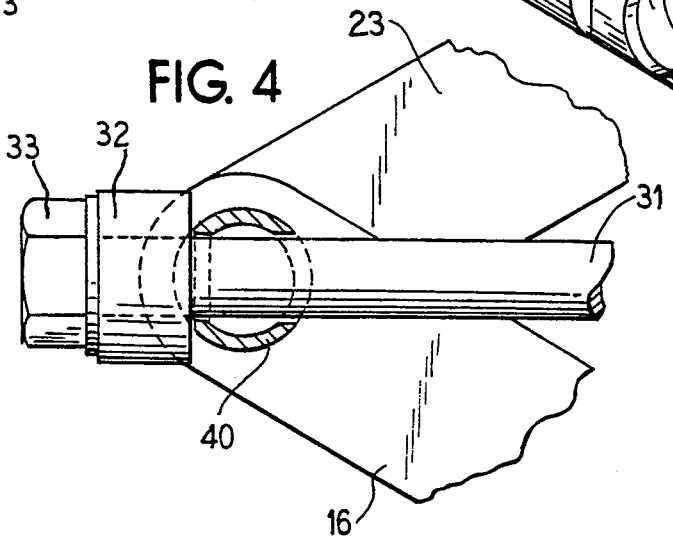
FIG. 4 is a sectional view illustrating the hollow trunnion of FIG. 3.

FIG. 1 illustrates a scissors jack with hollow trunnions of the invention mounted therein. A base 11 pivotally supports lower channel members 14 and 16 which are connected by pivot pins 12 and 13 to the base 11. A support 17 which has a vehicle engaging slot 18 is pivotally attached to upper channel members 22 and 23 by pivot pins 19 and 21. A hollow trunnion 34 according to the invention pivotally connects the upper end of the lower channel member 16 to the lower end of the upper channel member 23. The hollow trunnion member 34 is illustrated in perspective view in FIG. 2. It may be formed from a stamping which is formed into a hollow cylinder with the seam 38. A pair of openings 36 and 37 extend through the hollow trunnion 34 so as to receive therethrough the lead screw 31 of the jack. A bearing member 32 fits over the outer end of the lead screw 31 and bears against the hexagonal head 33 of the lead screw 31. FIGS. 3, 4 and 5 illustrate a modified form of the hollow trunnion 34. As shown in FIG. 3, a flatted portion 42 is formed in the wall of the trunnion 40 adjacent an opening 43 for the lead screw 31. The bearing 32 is received against the flatted portion 42 as shown in FIGS. 4 and 5. The hollow trunnion 40 is formed with a seam 41 as illustrated. The ends 46 and 41 extend beyond the sides of the upper and lower channel members 23 and 16 as illustrated in FIG. 5.

The threaded end 71 of the lead screw 31 passes through a hollow trunnion 61 shown in detail in FIG. 9 which has openings 68 and 69 for receiving the threaded end 71 of lead screw 31 therethrough. The lower ends of the upper channel member 22 and the upper ends of the lower channel member 14 are provided with openings through which the trunnion 61 extends as shown in FIG. 6. A U-shaped bracket 60 is formed with side legs 62 and 64 and an adjoining leg 63 which joins the legs 62 and 64. Openings 81 and 82 are formed in the end of legs 62 and 64 through which the hollow trunnion 61 extends as shown in FIG. 6. A threaded nut 66 is attached as by welding to the U-shaped bracket member 60 adjacent the cross-arm 63 as shown in FIGS. 6 and 7 and threadedly receives through the threaded opening 67 the threaded end 71 of the lead screw 31.

The hollow trunnion member 61 is formed with a gap 73 into which extensions 74 formed on the side legs 62 and 64 of bracket 60 are received as shown in FIG. 8. This aligns the openings 68 and 69 with the opening 67 so that the lead screw 31 will pass therethrough as shown in FIG. 7.

FIGS. 10, 11 and 12 illustrate a modified form of the invention somewhat similar to the embodiment shown in FIG. 6.

A solid trunnion 141 extends through openings in channel members 14 and 22 and is formed with an opening 143 through which the lead screw 31 extends. A U-shaped bracket 160 has side legs 162 and 164 and an adjoining leg 163 which joins legs 162 and 164. Opening 181 and 182 are formed in the ends of legs 162 and 164 through which trunnion 141 extends. A threaded nut 166 is attached as by welding to U-shaped bracket 160 and threadedly receives the lead screw 31 therethrough.

In use, as the hexagonal head 33 of the lead screw 31 is rotated, the threaded portion 71 of the lead screw 31 will cause the threaded nut 66 to move toward or away from the hexagonal head 33 raising or lowering the jack. If the jack is in the lowered position, the hexagonal nut 33 is rotated in a direction so as to cause the nut 66 to move toward the nut 33 thus raising the jack. Gear teeth 24 and 26, respectively, formed on the lower channel members 14 and 16 mesh with gear teeth 27 and 28 formed on the upper channel members 22 and 23 so as to raise and lower the jack.

Although the invention has been described with respect to preferred embodiments, it is not to be so limited as changes and modifications can be made therein which are within the full intended scope as defined by the appended claims.

I claim as my Invention:

1. A scissors jack comprising, a base member, a pair of lower channel members pivotally connected to said base member, a support member, a pair of upper channel members pivotally attached to said support member, a first hollow cylindrically-shaped trunnion formed with transverse openings which pivotally connects the lower end of one of said pair of upper channel members to the upper end of one of said pair of lower channel members, a second trunnion formed with a threaded opening which pivotally connects the lower end of the other of said pair of upper channel members to the upper end of the other of said pair of lower channel members, a lead screw which extends through said transverse openings of said first hollow cylindrical trunnion and is threadedly received through said threaded openings of said second trunnion, and an enlarged portion on said lead screw which bears against said first hollow cylindrical-shaped trunnion, and wherein a flatted portion is formed on said first hollow cylindrically shaped trunnion into which said enlarged portion is received.

2. A scissors type jack according to claim 1 wherein said enlarged portion is a collar received on said lead screw.

3. A scissors jack comprising, a base member, a pair of lower channel members pivotally connected to said base member, a support member, a pair of upper channel members pivotally attached to said support member, a first hollow cylindrically-shaped trunnion formed with transverse openings which pivotally connects the lower end of one of said pair of upper channel members to the upper end of one of said pair of lower channel members, a second trunnion formed with a threaded opening which pivotally connects the lower end of the other of said pair of upper channel members to the upper end of the other of said pair of lower channel members, a lead screw which extends through said transverse openings of said first hollow cylindrical trunnion and is threadedly received through said threaded opening of said second trunnion, and an enlarged portion on said lead screw which bears against said first hollow cylindrical-shaped trunnion, and wherein said second trunnion comprises a hollow cylindrical portion formed with transverse openings through which said lead screw extends and a U-shaped bracket formed with side legs that have openings through which the ends of said hollow cylindrical portion extend and a central leg formed with an opening through which said lead screw extends, and a nut attached to said central leg and said lead screw threadedly received therethrough.

4. A scissors type jack according to claim 3 wherein said hollow cylindrical portion is formed with at least one slot and at least one of said side legs is formed with a projection which is receivable in said slot.

5. A scissors type jack which has a threaded lead screw comprising, a solid trunnion through which said lead screw extends, a U-shaped bracket formed with side legs that have openings through which the ends of said solid trunnion extend and a central leg formed with an opening through which said lead screw extends, and a nut attached to said central leg and said lead screw threadedly received therethrough.

* * * * *